United States Patent [19]

Siegel

[11] 4,250,938

[45] Feb. 17, 1981

[54] HANDBAG

[75] Inventor: Milton I. Siegel, Scottsdale, Ariz.

[73] Assignee: AMBA Marketing Systems, Inc., Tempe, Ariz.

[21] Appl. No.: 905,796

[22] Filed: May 15, 1978

[51] Int. Cl.[3] ..... A45C 1/08; A45C 15/00

[52] U.S. Cl. ..... 150/35; 150/28 R

[58] Field of Search ..... 150/28 R, 30, 34, 35, 150/42, 46; 206/45.2, 45.23, 542

[56] References Cited

U.S. PATENT DOCUMENTS

| | | | |
|---|---|---|---|
| D. 157,266 | 2/1950 | Kiernan | 150/28 |
| D. 157,738 | 3/1950 | Chase | 150/28 |
| 1,425,217 | 8/1922 | Regulski | 150/35 |
| 1,495,220 | 5/1924 | Carrol | 150/52 R |
| 1,684,381 | 9/1928 | Bahr | 150/28 |
| 2,005,791 | 6/1935 | Kruse | 190/52 |
| 2,327,301 | 8/1943 | Davis | 206/45.23 |
| 2,544,493 | 3/1951 | Filenbaum | 150/28 |
| 3,414,033 | 12/1968 | Tucker | 150/28 A |
| 3,696,850 | 10/1972 | Rosenblum | 190/52 |
| 3,963,102 | 6/1976 | Carp | 150/30 |

FOREIGN PATENT DOCUMENTS

| | | | |
|---|---|---|---|
| 840343 | 7/1960 | United Kingdom | 190/52 |
| 872727 | 7/1961 | United Kingdom | 190/52 |

*Primary Examiner*—Herbert F. Ross

*Attorney, Agent, or Firm*—Gregory J. Nelson

[57] ABSTRACT

A ladies handbag having a main handbag component and a separate detachable organizer clutch purse component is disclosed. The clutch purse has an organizer section for the convenient reception and display of cosmetic items and attaches to the main handbag at a hinged rear flap, or, in another embodiment, is receivable in an inner pocket of the main handbag. In one embodiment the organizer clutch is provided with expandable loops which conveniently retain cosmetic accessories in place. A viewing slot in the organizer clutch permits the user identification and access to the contained items. The organizer clutch includes a closure flap carrying a make-up mirror.

7 Claims, 13 Drawing Figures

HANDBAG

The present invention relates to handbags and more particularly relates to a compartmentalized or organizer handbag providing for the convenient arrangement of personal effects, particularly cosmetic items.

Use of handbags by women for carrying various accessory articles in an established practice. Accessories commonly carried include such items as credit cards, photographs, glasses checkbooks, wallet, change purse, note paper, and a wide variety of cosmetics. Generally, handbags are designed to aesthetically appeal to the user, and are not particularly well suited to organize and receive articles carried by women. Often, the articles end up in a mixed array at the bottom of a handbag.

More recently, organizer type handbags have been designed and developed having various compartments and pockets for orderly storage of assorted personal items. For example, U.S. Pat. No. 3,955,609 shows a handbag of this general type, having a main compartment and various storage compartments and pockets. This handbag represents a substantial advance in the state of the art having found wide acceptance. This handbag has specialized storage compartments for most items women need in their daily activities, such as credit cards, glasses, checkbooks, change, tissues and the like.

However, in addition to these items, many women carry a variety of cosmetic items generally packaged or contained in elongate cylinders. Such items include mascara, lipstick, perfume, eye shadow and the like.

Prior art handbags, even specialized organizer handbags as mentioned above, generally do not provide for cosmetic items.

Accordingly, the present invention provides a ladies handbag for cosmetic items. Briefly, the present invention provides a handbag combination having two cooperating components including a main handbag with one or more compartments for reception of personal items. A separate, detachable cosmetic organizer clutch purse is secured to one side of the handbag. The organizer clutch purse can be removed and carried as a separate item, if necessary. The organizer clutch has a generally rectangular body, defining a main compartment. The main compartment is provided with an organizer section to receive and store cosmetic items. A closure flap carries a mirror for assisting in the application of cosmetics. A rear panel, hingedly affixed at the rear of the main compartment of the purse is insertable in a pocket or slit formed in the handbag so the clutch purse can be detachably secured to the main handbag. The rear flap can also be secured to the mirror carrying closure flap when this flap is reversely positioned to form a stand, so the purse can be placed in a free-standing upright position for convenient access to the contained cosmetic items. In another embodiment, the organizer clutch is receivable in a pocket provided in the main handbag compartment.

The above and other objects and advantages of the present invention will be more fully understood and appreciated from the following specification, claims and drawings in which:

Figure 12:
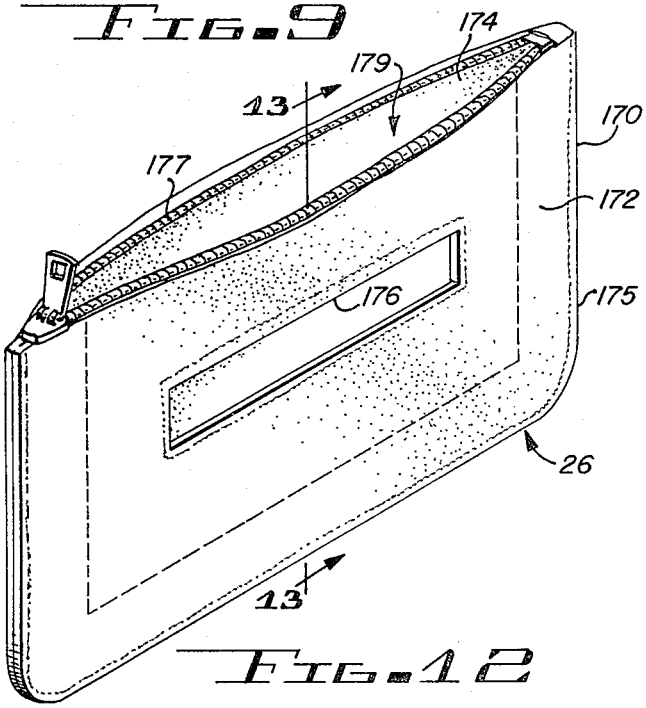

FIG. 12. is a perspective view of a tissue dispenser and cosmetic case; and

Figure 13:
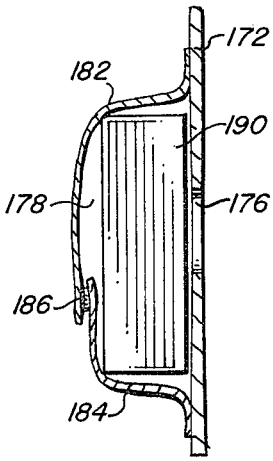

FIG. 13 is a sectional view taken along lines 13—17 of FIG. 12.

Turning now to the drawings in which the same reference numerals indicate corresponding elements throughout the several views. A ladies handbag constructed in accordance with the teachings of the present invention is generally designated by the numberal 10. The handbag 10 consists of two components, a main handbag 12 and a removable cosmetic clutch purse 14. The handbag 12 is constructed in a more or less conventional manner, having a front panel 16 and a rear panel 18, interconnected at opposite ends by end panels 20 and 21 and a bottom panel 22. These panels define a main central compartment 24 for reception of various items such as tissue carrier and dispenser 26, coin purse 28, and checkbook 30.

A carrying strap 32 is secured at opposite ends to end panels 20 and 21. Carrying strap is formed having a loop or ring 36 at either end panel secured to the end panels by tabs 38 and rivets 40. As mentioned above, the particular construction of the handbag 12 may vary and the particular configuration of this bag insofar as arrangement and positioning of pockets and compartmentalization forms no part of the present invention.

Figure 1:
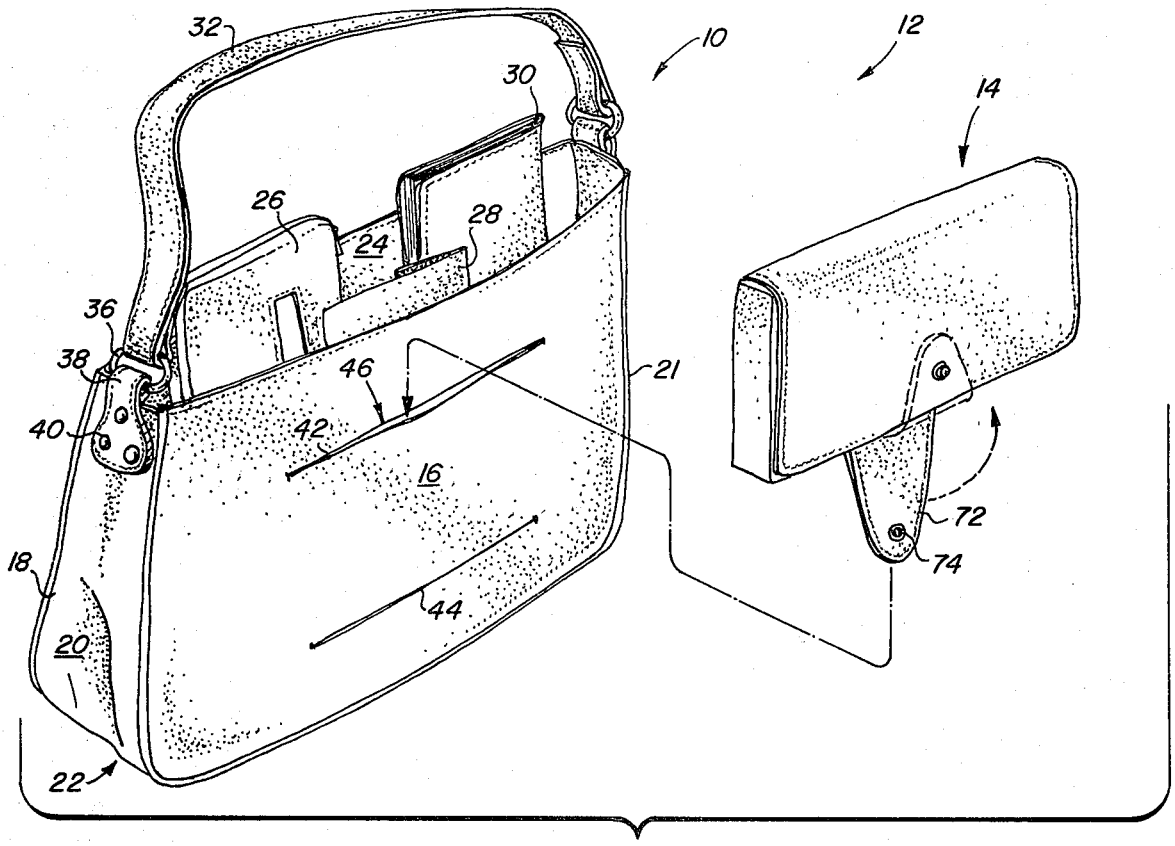
FIG. 1 is a front exploded perspective view generally illustrating both components; the ladies handbag and organizer clutch purse in accordance with the teachings of the present invention.
Figure 2:
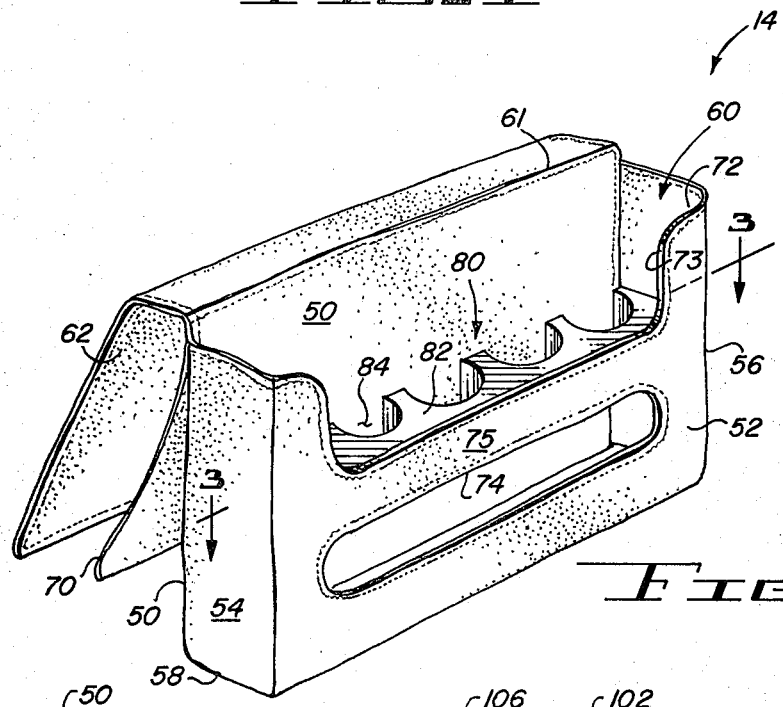
FIG. 2 is a front perspective view of the cosmetic clutch purse in an open position.
Figure 3:
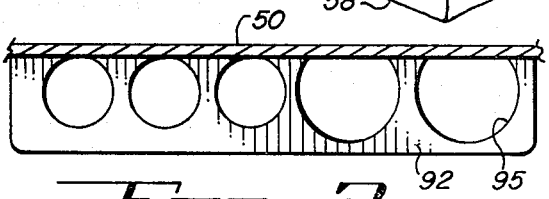
FIG. 3 is a plan view showing one form of organizer section that may be incorporated in the clutch purse.

In accordance with the present invention, the handbag 12 detachably carries a cosmetic organizer clutch purse 14. Handbag 12 is provided with fastening means for detachably securing the clutch purse 14. As shown in FIG. 1, the attachment means comprise a pocket 46 defined by a pair of horizontally extending spaced apart slits or openings 42 and 44 in the outer ply of the front panel 16. Pocket 46 may be formed as shown having openings 42 and 44 on either side or may be a conventional pocket as will be described with reference to alternate embodiments of the present invention. Some other type of fastening means such as a snap fastener or a loop and pile material such as that sold under the trademark "Velcro" may be also used to detachably secure purse 14 to handbag 12.

Figure 4:
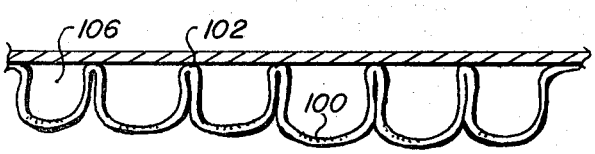
FIG. 4 is a plan view showing another type of organizer section that may be incorporated in the cosmetic clutch purse.
Figure 5:
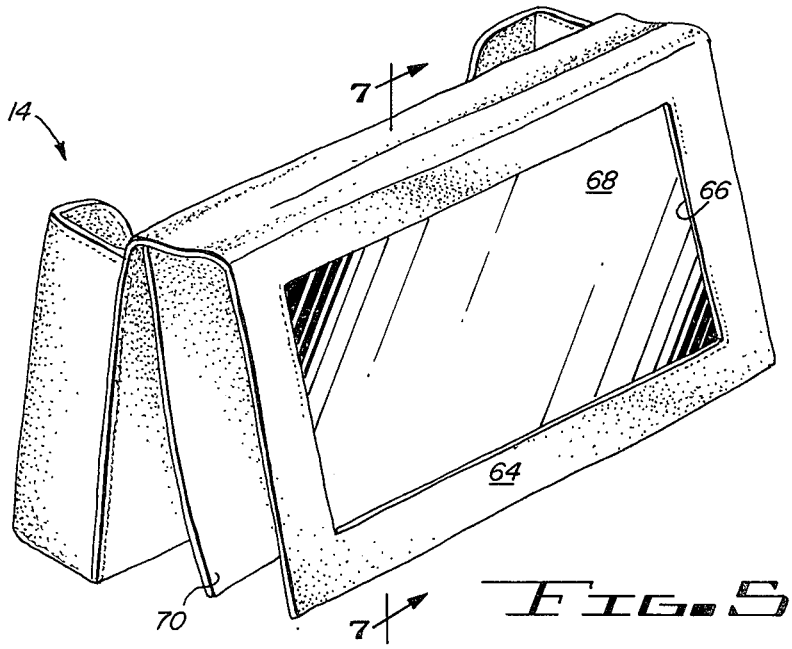
FIG. 5 is a rear perspective view of the clutch purse showing the rear flap and closure flap positioned to maintain the purse in a free-standing position.

The construction of the organizer clutch purse 14 is shown in greater detail in FIGS. 2 through 6. The clutch purse 14 has a generally rectangular rear panel 50, a front panel 52, opposite end panels 54 and 56, and a bottom 58 which define generally rectangular compartment 60. The terms "front" and "rear" are used herein to establish a frame of reference and are not intended to be limiting. A closure flap 62 is hingedly affixed along the upper horizontal edge 61 of rear panel 50. The flap 62 is generally rectangular and in the closed position flap 62 extends across the top of compartment 60 and overlies the front panel 52 of the purse. The inner surface of panel 62 is provided with a facing 64 of material which serves as a lining. As best seen in FIG. 5, facing 64 defines a generally rectangular cut-out 66 which secures a mirror 68 by engagement of the peripheral edges of the mirror. In the closed position, mirror 68 is adjacent the front panel 52 of the organizer clutch 14.

Figure 7:
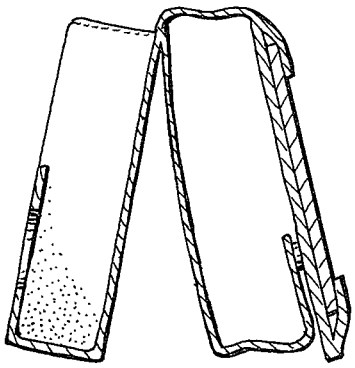
FIG. 7 is a sectional view taken along lines 7—7 of FIG. 5.
Figure 8:
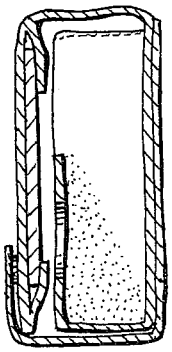
FIG. 8 is a transverse sectional view of the cosmetic clutch purse in a closed position.

A rear flap 70 is also hingedly affixed along the upper horizontal edge 61. Flap 70 corresponds in size and shape to rear panel 50 of the purse and preferably, flap 70 and closure flap 62 are formed from a single piece of material, stitched to back panel 50 at upper horizontal edge 61. A tab 72 projects from the center portion of the lower edge of flap 70 and carries one portion of a fastener 74 which can be engaged with the mating fastener portion 76 carried on the exterior side of closure flap 62. The fastener portions 74 and 76 can be engaged in either of two positions as shown in FIGS. 7 and 8 as will be more fully explained.

The front panel 52 of purse 14 is formed having an upper edge 72 which has a central recess 73 providing access to the contents of compartment 60. A cut-out 74 subjacent edge 72 provides a viewing "window" so that the contents of the compartment can be better seen and labels or indicia carried on contents of the compartment will be readily viewable by the user. A section 75 extends above the cut-out 74.

An organizer section 80 is secured to the interior of section 75 by a fastener or a suitable bonding agent. Organizer section 80 is shown as body 82 of wood or molded plastic having a plurality of recesses forming channels 84. The channels 84 are shown as being generally semi-circular and being sized to accommodate the various cosmetic items normally carried by women. As mentioned above, most of these cosmetic items are supplied in cylindrical containers. It will be obvious that channels 84 can be configured in other shapes as necessary. For example, referring to FIG. 3, the organizer 90 is formed from an elongate bar 92 having a plurality of cylindrical bores 95 in preselected sizes secured or bonded to the interior of rear panel 50. Similarly, the organizer may also be formed, as shown in FIG. 4, having an expandable or elastic band 100 stitched at various locations 102 to the interior of rear panel 50 forming a number of loops 106 for insertion of cosmetic items and other objects.

The handbag of the present invention will be more fully understood and appreciated from the following description of use. The components are assembled by inserting flap 70 of purse 14 into pocket 46 on the front of handbag 12. Tab 72 is extended across the bottom panel 58 of the purse and brought into juxtaposition with the exterior of closure flap 62 and the retaining fastener portions 74 and 76 are engaged. With the handbag assembly 10 secured in this fashion, the user has access to the storage compartments of the handbag 12. Access to cosmetic items is achieved by detaching tab 72 and opening closure flap 62. The construction of the clutch purse 14 and particularly the cut-out 74 permits the user easy identification of the contents of the purse and items are easily removable as they are arranged in an accessible, organized position within compartment 60. Mirror 68 on the interior of closure flap is in position of use when the flap is open to accommodate application of cosmetics.

Figure 6:
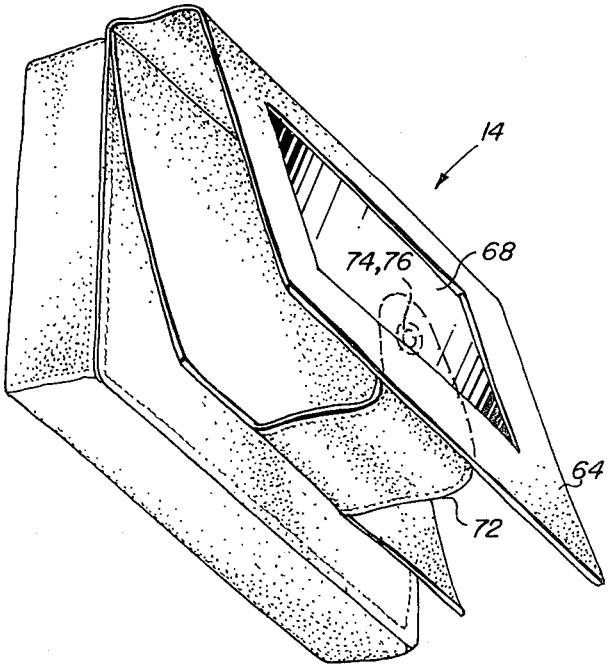
FIG. 6 is a bottom perspective view illustrating the cosmetic clutch bag secured to place the purse in a free-standing position.

In the event the user wants to utilize the organizer clutch 14 separate from the handbag 12, the clutch 14 can be removed by slipping rear flap 70 from pocket 46 detaching the purse 14. The clutch purse can be carried as a separate item or placed in another handbag or used for a convenient and orderly storage of cosmetics while travelling. In the event the user wishes to apply makeup, the clutch purse can be positioned in a freestanding position by reversely positioning the closure flap 62 as shown in FIGS. 6 and 7. Tab 72 is secured to the exterior of closure flap 62 by engaging snap fastener members 74 and 76. The closure flap and the rear flap are fixed together to form a stand for the main compartment 60 of the purse. Thus, the purse may be placed on a counter or table for application of cosmetics. The mirror is conveniently positioned and the contained cosmetics are conveniently displayed. The freestanding position is best illustrated in FIG. 7. When the purse is not in use, the purse can be placed in the closed position as shown in FIG. 8 with closure tab engaged in the closed position.

Figure 9:
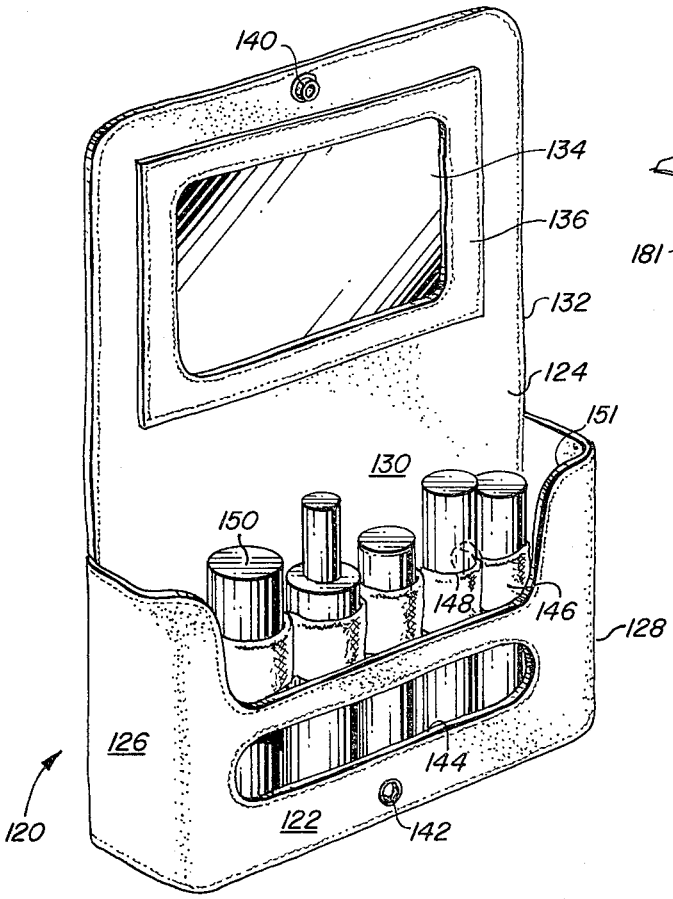
FIG. 9 is a perspective view illustrating another form of the clutch organizer in an open position with cosmetic items contained therein.
Figure 10:
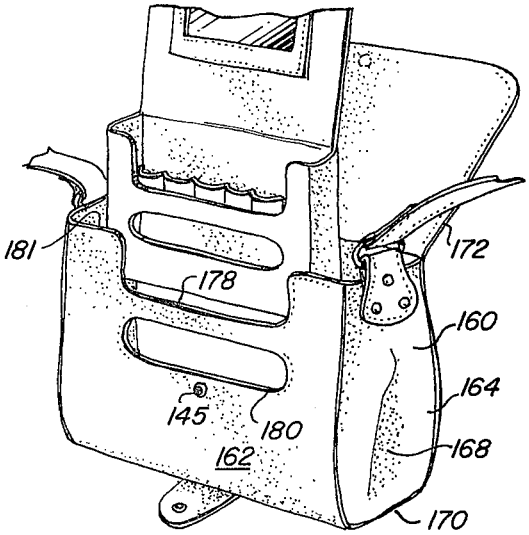
FIG. 10 is a front view illustrating the insertion of the clutch organizer of FIG. 9 in a pocket of the main handbag.
Figure 11:
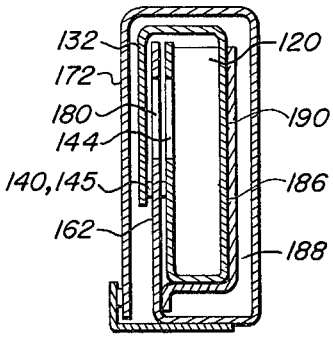
FIG. 11 is a vertical sectional view through the main handbag and organizer clutch showing the organizer clutch in position in its retaining pocket.

FIGS. 9–11 illustrate another form of handbag of the present invention. Referring to these figures, a main handbag 160 is formed having front and rear panels 162 and 164 joined at opposite edges at side panels 168 and bottom panel 170. A closure flap 172 is stitched or otherwise hingedly affixed to the upper horizontal edge of rear panel 164. Front panel 162 has an upper edge 181 defining a recess 178. A generally elongate cutout or opening 180 extends horizontally in panel 162 below recess 178. As best seen in FIG. 11, a pocket 186 is formed within compartment 188 of handbag 160 by panel 190 which is stitched or otherwise secured to the interior side of panel 162. The pocket 186 is designed to receive organizer clutch 120 as shown in FIGS. 10 and 11.

Organizer clutch 120 is best illustrated in FIG. 9. Organizer clutch 120 is formed from any suitable material such as leather, vinyl and the like, and has front and rear panels 122 and 124 joined at opposite edges at side panels 126 and 128. Compartment 130 is defined by the panels. A closure flap 132, which is shown as an extension of rear panel 124, adapts to overlie the front panel 122 in a closed position. The interior side of flap 132 is provided with a mirror 134 which is secured in place by a frame 136 which is stitched or otherwise secured to the interior of panel 132.

The upper edge of front panel 122 is configured having a recess 151 which conforms in shape and configuration to recess 178 in the front panel 162 of the handbag. The recess allows the user better view of the contents 150 of the organizer clutch purse.

An elongate cutout 144 is provided in the front panel 122 of the organizer 120. Cutout 144 corresponds in location and shape to cutout 180 in the front panel and 162 of the handbag. When organizer clutch 120 is inserted in pocket 180, the cutouts 144 and 180 are in alignment. This enables the user to lift flap 132 and view the contents and appropriate indicia on contents such as names, colors or other descriptive information on the containers 150.

The cosmetic accessories 150 are secured in place by a series of elastic loops 146 formed from the continuous elastic or expandable band stitched transversely at various locations 148.

Matching fasteners sections 140 and 142 on the interior flap 132 and exterior surface of panel 122 allow the organizer to be placed in a closed position with the fasteners sections engaging. FIG. 11 shows the organizer clutch in position within receiving pocket 190. Note that the cutouts 144 and 180 are in alignment in this position. The upper flap 132 is folded over the outer side of panel 162 and fastener portion of 140 engaged in mating fastener portion 145 on the exterior of handbag panel 122. This engagement prevents the organizer clutch from being dislodged from its position in the pocket 186.

As seen in FIG. 10, the organizer clutch may be removed from the main handbag 160 and used in another bag when handbags are changed.

FIG. 12 shows an accessary item 26 for use with the present handbag. The accessory item 26 is in the form of a pouch having a front panel 172 and a rear panel 174 stitched along marginal edges 175. A zipper closure 177 extends along the upper edges of the front and rear panels. A generally elongate rectangular cutout 176 is provided in the front panel 172. An interior pocket 178 is provided within the compartment 179 of the pouch. Interior compartment 178 is designed to hold convenience items such as tissue papers packaged in a small pop-up container. Pocket 178 is formed by an upper flap 182 which is joined to the inner side of panel 172 near the upper horizontal edge. A lower flap 184 is also joined to the interior side of panel 172. The flaps 182 and 184 can be engaged at snap fastener member 186 to form pocket 178. The pocket is shaped and configures to accommodate tissue dispenser 190 as shown. The contained tissue projects through opening 176 for easy removal. Other items needed for the application of cosmetics and beauty aids can be contained in pouch 170. Typical of these items are powders, blushers, combs and other personal items. The cosmetic case and zipper dispenser 26 can be contained in main handbag of the present invention or may be used as a separate accessory item with other handbags.

The handbag of the present invention can be fabricated from a selection of suitable materials, such as cloth, leather or vinyl and affixed together by sewing or bonding.

It will be obvious to those skilled in the art to make various changes, alterations and modifications to the invention described herein. To the extent that these changes, alterations and modifications do not depart from the spirit and scope of the appended claims, they are intended to be encompassed herein.

We claim:

1. A clutch purse for receiving and storing cosmetic items of the type generally contained in cylindrical containers and cooperable with a main handbag having exterior fastening means therein; said purse comprising:

(a) a body having front, rear, end and bottom panels defining a compartment therebetween, said rear panel having an upper horizontal edge, (b) a closure flap having dimensions generally corresponding to the dimension of the front panel and hingedly secured to said purse rear panel along said upper horizontal edge, said closure flap having a first closed position substantially overlying said front panel and a second open position with the flap reversely folded adjacent and spaced from said rear panel;

(c) second flap means dimensioned generally corresponding to the dimensions of said rear panel and hingedly secured to said rear panel along said upper horizontal edge, said second flap receivable in said exterior fastening means for selectively attaching or detaching said purse to said handbag;

(d) tab means secured to said second flap means, said tab having means for securement to said closure flap whereby said tab can be secured to said closure flap in said second closure flap position to form a brace to position said purse in a free-standing position and whereby said tab means can be secured to said closure flap in said first position to close said purse; and (e) organizer means in said purse compartment comprising a plurality of retention channels for the orderly containment of personal items such as generally cylindrical cosmetic containers; said front panel defining an opening to provide the user with a view of at least a portion of said containers.

2. The purse of claim 1 wherein said closure flap carries a mirror which is exposed when said closure flap is reversely folded in said open position.

3. The purse of claim 1 wherein said organizer means comprises a tray defining multiple channels for reception of cosmetic items.

4. The purse of claim 3 wherein said front panel has a recessed upper edge and a cut-out therein for convenient viewing and access to the items in said compartment.

5. An organizer handbag combination for receiving and storing personal accessory items comprising:

(a) a main handbag having at least front and rear panels defining at least one compartment and including a purse receiving section; and (b) a purse including:

(i) front and rear panels defining a body having a compartment, said rear panel having an upper horizontal edge;

(ii) a closure flap having dimensions generally corresponding to the dimension of the front panel and hingedly secured to said purse rear panel along said upper horizontal edge, said closure flap having a first closed position substantially overlying said front panel and a second open position with the flap reversely folded adjacent and spaced from said rear panel;

(iii) second flap means releasably secured to said section and dimensioned generally corresponding to the dimensions of said rear panel and hingedly secured to said rear panel along said upper horizontal edge;

(iv) tab means secured to said second flap means, said tab having means for securement to said closure flap whereby said tab can be secured to said closure flap in said second closure flap position to form a brace to position said purse in a free-standing position and whereby said tab means can be secured to said closure flap in said first position to close said purse; and (v) organizer means in said purse compartment comprising a plurality of retention channels for the orderly containment of personal items such as generally cylindrical cosmetic containers; said front panel defining an opening to provide the user with a view of at least a portion of said containers.

6. The organizer handbag of claim 5 wherein said main handbag defines a second compartment for reception of a pouch and further including pouch means having a front panel defining an opening therein and pocket means at the interior of said front panel formed by attachable flap means, said pocket adapted for reception of tissues whereby the tissues can be removed at the exterior of said front panel through said opening and whereby said pouch is nestably receivable in said second compartment.

7. The handbag combination of claim 5 wherein said organizer means comprises elastic retaining means.

* * * * *